United States Patent [19]

Bosse

[11] 4,174,804

[45] Nov. 20, 1979

[54] SYMMETRICAL SACK WITH DOUBLE SIDE FOLDS

[75] Inventor: Frank Bosse, Tecklenburg, Fed. Rep. of Germany

[73] Assignee: Windmoller & Holscher, Lengerich, Fed. Rep. of Germany

[21] Appl. No.: 904,320

[22] Filed: May 9, 1978

[30] Foreign Application Priority Data

May 13, 1977 [DE] Fed. Rep. of Germany ..... 2721771

[51] Int. Cl.[2] ..... B65D 33/02; F15B 15/22

[52] U.S. Cl. ..... 229/55; 93/8 W; 93/19; 93/35 R; 428/35; 428/36

[58] Field of Search ..... 229/55; 93/8 W, 19, 93/20, 35 R; 428/35, 36

[56] References Cited

U.S. PATENT DOCUMENTS

| | | | |
|---|---|---|---|
| 2,418,371 | 4/1947 | Smellie | 229/55 |
| 3,540,356 | 11/1970 | Lecomte | 229/55 |
| 3,570,749 | 3/1971 | Sato et al. | 229/55 |
| 3,929,275 | 12/1975 | Bolling et al. | 93/8 W |

*Primary Examiner*—William R. Dixon, Jr.
*Attorney, Agent, or Firm*—Fleit & Jacobson

[57] ABSTRACT

Lined plastics sacks are made from tube sections successively severed from a tubular web consisting of a tubular inner layer of thermoplastic film around which a circular fabric of stretched plastics tapes is woven to form an outer layer. In each severed tube section, the layers are interconnected by a seam at one end to define a sack. The outer layer may be formed with side pleats defining three outwardly directed folds, the inner layer being flattened and disposed in the central such fold before the sack is filled.

3 Claims, 4 Drawing Figures

FIG.1
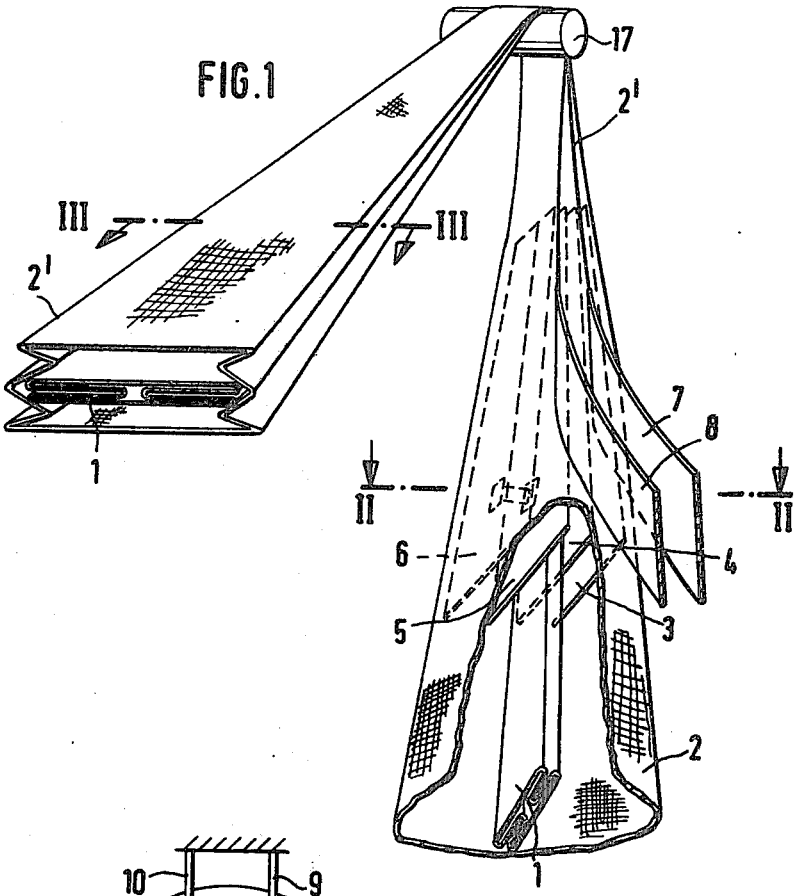
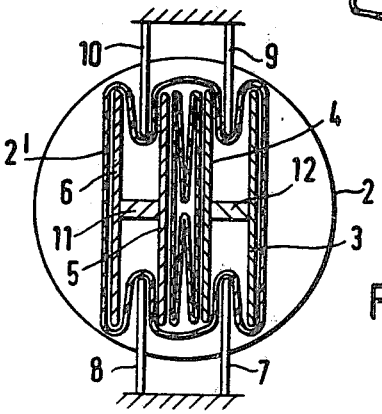
FIG.2

SYMMETRICAL SACK WITH DOUBLE SIDE FOLDS

The invention relates to a method of making sacks open at one end or one-sidedly open sacks comprising a supporting outer sack and a sealing inner sack of thermoplastic film connected thereto by the base seam, wherein the outer tube defining the outer sack is formed around a flat tube defining the inner sack, tube sections are severed from the double tubular web, and the sections are provided with a base seam engaging both tube sections, and to a sack made by this method.

Methods of this kind are known for example from U.S. Pat. No. 3,183,797 as well as Japanese Specification 35 459/1970, wherein an outer tube formed from a paper web and layed into side folds is folded around an inner tube of thermoplastic film laid into side folds or a flat inner tube of which the side strips are folded inwardly, the outer tube being closed by a central adhesive seam. A good loading capacity of sacks made by this method, which loading capacity is limited by the strength of the outer sack material and the base seam, is achieved if, during filling, the inner sack comes to lie as smoothly and uniformly as possible against the supporting and carrying outer sack so that overstretching of the inner sack is excluded and the outer sack is employed uniformly for carrying purposes.

Large sacks, particularly container sacks, cannot be made by this known method because the paper outer sack provided with a longitudinal seam is insufficiently strong.

It is the problem of the present invention to provide a method of the aforementioned kind for making large sacks.

This problem is solved according to the invention in that a circular fabric of stretched plastics tapes defining the outer sack is woven around the flattened or flattened and folded inner tube. For example, polypropylene tapes have their strength increased tenfold by their stretching so that tubes woven from such tapes and not weakened by a longitudinally extending seam are sufficiently strong to be made into outer sacks of large sacks and container sacks. The tubular film subsequently forming the inner sack can be fed through the circular weaving loom so that the outer tube is woven therearound and the fabric tube with inner tube produced in this manner can be passed on for further processing to form large sacks.

A suitable circular weaving loom for weaving around an inner tube is known for example from DT-AS 1,086,188.

According to one embodiment of the method of the invention, it is provided that the circular fabric tube is provided with double side folds and the inner tube, which has a single side fold, is placed in the outwardly directed folding between the side folds. If tube sections are severed from the double tube made by this method and provided with a base seam, symmetric sacks with double side folds are obtained on which bases of high loading capacity are formed after filling which also give the sacks a good stability. By reason of the symmetrical construction of the sack, the inner sack provided with a side fold lies against the side walls of the supporting woven outer sack because during filling the distances of the walls of the inner sack to the walls of the outer sack against which they lie intimately are substantially equal. After filling, a substantially hexagonal base is formed in which the bulge formed by the central side fold is subjected to only low loads which do not cause high loading of the base seam because the stresses extend diagonally into the gussets formed by the side folds with the base seam.

The double side folds should not be deeper than is necessary for forming a base which gives the sack adequate stability. Formation of the base can actually be improved by increasing the number of side folds because the shaping of the base is more favourable the closer it approaches a circle. However, the more side folds there are the more difficult it becomes to apply the base seam because with each additional side fold there is an increasing number of layers to be penetrated by the seam.

To achieve a sealed inner sack, the tubular film with side folds forming the inner sack is desirably welded off in the region of the base seam. The base seam closing the woven outer sack is preferably a stitched seam because a welded seam could result in a heat effect lying above the relaxation temperature, which would nullify the strength-increasing stretching of the tapes forming the fabric.

An example of the invention will hereinafter be described in more detail with reference to the drawing, wherein:

FIG. 1 is a diagrammatic perspective view showing insertion of the inner tube provided with side folds in the central fold of the woven outer tube provided with double side folds;

FIG. 2 is a section through the folds and folding blades taken on the line II—II in FIG. 1;

Figure 4:
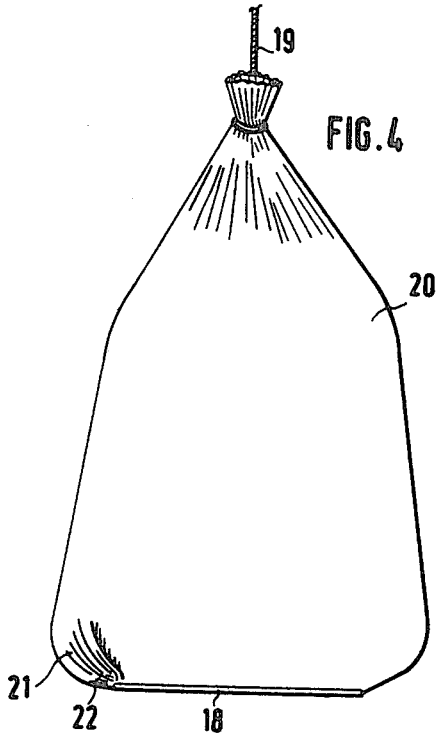
FIG. 4 is a perspective view of a sack made from a tube section according to FIG. 3.

To make the tubular web, which consists of a tubular film 1 laid into side folds and disposed between the central side folds of a woven outer tube provided with double side folds, the pleated tube 1 is fed to a circular weaving loom (not shown). The pleated tube 1 can for this purpose be withdrawn from a supply reel (not shown). After the pleated tubular film 1 has had a tubular circular fabric 2 of stretched plastics tapes woven around it, it passes between parallel folding plates 4, 5 which are secured to the loom and to which two further parallel folding plates 3, 6 are attached at a spacing by way of struts 11, 12. Projecting into the spaces formed between the folding plates 3 and 4 as well as 5 and 6 there are oblique folding blades 7, 8 and 9, 10 which lay the initially circular woven outer tube 2 into double side folds in such a way that the folding plates 4, 5 lie between the double side folds. When the continuously withdrawn tubes 1, 2 run off the folding plates 3 to 6 as well as the folding blades 7 to 10, the inner pleated tube 1 lies between the double side folds of the circular fabric tube in the outwardly directed fold.

Figure 3:
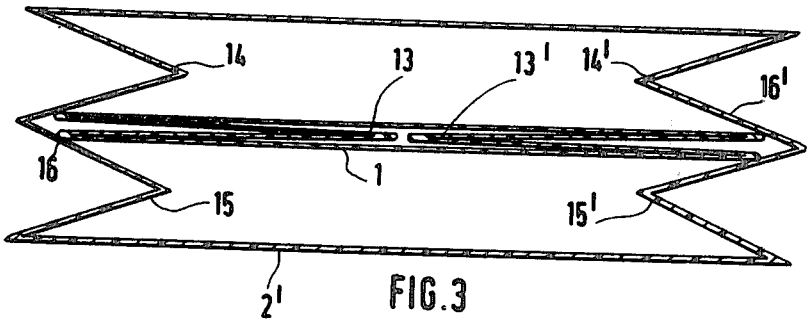
FIG. 3 is a section through the tubular webs provided with side folds taken along the line III—III in FIG. 1.

The position of the inner and outer tubes is shown to a larger scale in FIG. 3. The plastics inner tube 1 provided with the single side folds 13, 13' lies in the woven outer tube 2' in the outwardly directed fold 16, 16' which is formed between the double side folds 14, 15 and 14', 15'.

The flat double tubular web 1, 2' is, after it has been passed over the guide roller 17 and possibly other guide rollers and squeeze rollers (not shown), fed along for further processing or coiled to form a storage reel.

A filled container sack made from a tube section severed from the double tubular web is illustrated in FIG. 4. The base of this sack which has its upper end gathered, closed with the cord 19 and suspended thereby was closed by a stitched seam 18 passed through the folded over end of the flat tube section. The seam 18 can also be passed through a rider tape embracing the free or folded end of the base. By reason of the filling, the fold 16 defined between the double side folds 14, 15 and 14', 15' is pulled out of the sack 20 in the form of a bulge 21. The folds 22 disposed between this bulge and the sack run substantially diagonally into the base seam 18 to result in a favourable stress distribution.

The sack 20 is shown in the suspended condition. If it is deposited on a supporting foundation, a substantially hexagonal base is formed which gives the sack a good stability so that it remains upstanding.

The folding plates and folding blades diagrammatically shown in FIG. 1 are tapered in the direction of travel of the double sack web so that the tubular webs are folded tightly within one another.

I claim:

1. A symmetrical tubular sack with double side folds comprising a supporting outer sack and a sealing inner sack of thermoplastic film, the outer sack comprising a woven circular fabric tube section of stretched plastic tapes separate from the inner sack and provided with double side folds, and the inner sack comprising a tube section provided with a single side fold and placed in the outwardly directed fold located between the double side folds of the outer sack.

2. A method of making end open sacks comprising a supporting outer sack and a sealing inner sack of thermoplastic film connected thereto by the base seam, the method comprising forming an outer tube defining the outer sack separate from and surrounding a flat tube defining the inner sack, severing tube sections from the double tubular web, and providing the sections with a base seam engaging both tube sections, the outer tube being comprised of a circular fabric of stretched plastics tapes woven around the flattened or flattened and folded inner tube.

3. A method according to claim 1, further comprising providing the circular fabric tube with double side folds, and placing the inner tube, which has a single side fold, in an outwardly directed folding between the side folds.

* * * * *